US006938603B2

(12) United States Patent
Scharp

(10) Patent No.: US 6,938,603 B2
(45) Date of Patent: Sep. 6, 2005

(54) METHOD FOR THE PRODUCTION OF A ONE-PIECE PISTON FOR AN INTERNAL COMBUSTION ENGINE

(75) Inventor: Rainer Scharp, Vaihingen (DE)

(73) Assignee: Mahle GmbH, Stuttgart (DE)

( * ) Notice: Subject to any disclaimer, the term of this patent is extended or adjusted under 35 U.S.C. 154(b) by 71 days.

(21) Appl. No.: 10/748,902

(22) Filed: Dec. 30, 2003

(65) Prior Publication Data

US 2004/0231631 A1 Nov. 25, 2004

(30) Foreign Application Priority Data

May 21, 2003 (DE) ..... 103 22 921

(51) Int. Cl.[7] ..... F02B 75/06

(52) U.S. Cl. ..... 123/193.1; 29/888.04; 29/888.044; 29/888.049; 29/888.05

(58) Field of Search ..... 123/193.1, 193.6, 123/193.4; 29/888.04, 888.044, 888.049, 888.05

(56) References Cited

U.S. PATENT DOCUMENTS 6,415,191 B1 * 7/2002 Pryor ..... 700/95
6,487,773 B1 * 12/2002 Scharp et al. ..... 29/888.04
6,760,961 B2 * 7/2004 Upadhya ..... 29/27 C

FOREIGN PATENT DOCUMENTS

EP 0 027 445 4/1979

* cited by examiner

*Primary Examiner*—Bibhu Mohanty
(74) *Attorney, Agent, or Firm*—Collard & Roe, P.C.

(57) ABSTRACT

A method for the production of a one piece piston for an internal combustion engine. The piston has a ring shaped cooling channel arranged in an outer region of a piston head. The channel is partially closed off by a circumferential projection structured as an oil groove. The piston is produced in a simple and inexpensive manner using a piston blank using cutting work such as lathing.

10 Claims, 4 Drawing Sheets

METHOD FOR THE PRODUCTION OF A ONE-PIECE PISTON FOR AN INTERNAL COMBUSTION ENGINE

CROSS REFERENCE TO RELATED APPLICATIONS

Applicant claims priority under 35 U.S.C. §119 of German Application Serial No. 103 22 921.3 filed on May 21, 2003.

BACKGROUND

The invention relates to a method for the production of a one-piece piston for an internal combustion engine.

One piece pistons are known in the art, such as the one-piece piston shown in European Patent EP 0 027 445 B1. In that patent, the piston is formed using the casting method. To be able to better utilize the available oil amount for cooling the piston, the known piston has a cooling channel, which is partly closed, formed in its edge region, by a projection structured as an oil groove. With this design, the projection is molded partly onto the pin boss supports and partly onto the skirt connection, which has the result that the production of the known piston, using casting technology, is very complicated and requires casting dies that consist of several parts. This has the disadvantage that the production of the piston known from the state of the art is very complicated and expensive. Furthermore, the production of pistons by means of casting technology always brings the risk with it that casting voids, will form in the piston during production. These casting voids make the piston completely unusable.

Thus, the invention is based on the task of avoiding the stated disadvantages of the state of the art.

SUMMARY OF THE INVENTION

The invention relates to a method for the production of a one piece piston for a combustion engine. In this case, the method comprises forging a piston head from a piston blank wherein the piston head extends along a longitudinal axis and is formed in a substantially cylindrical manner having a radial outer region. Next, the piston head is cut to form a recess on a side of the piston head to form a ring wall and a protrusion which results in a ring shaped gap between the protrusion and the ring wall. In this case, the protrusion has an outer radial region that is radially inside of a radial inside region or ring wall by a distance (y). Next, a cooling channel is machined using a machine tool having a width that is smaller than the distance (y) wherein the cooling channel is disposed in an outer region of the piston head with a radially outer delimination formed by a ring wall molded into the piston head, and a radially inner delimination which is formed by a ring wall molded onto the piston head. In this case, the radially inner delimination is formed partly by pin boss supports and partly by skirt connections.

Next, a projection is machined by forming a groove shaped undercut, which faces towards the piston head, structured as an oil groove, which is molded partly on to the at least one pin boss support and partly onto the at least one skirt connection wherein the cooling channel is partly closed off towards a side of the pin bosses.

Next, at least one pin bore is machined in the piston head wherein this pin bore forms at least one pin boss having at least two pin boss supports and at least one face formed integral with the piston head. In this case, the pin boss supports and the face are arranged set back relative to the radial outer region of the piston head.

An outside contour of the piston can be machined wherein this step includes forming at least two skirt elements coupled to the pin boss in the piston head, via a skirt connection having at least one recess between the skirt elements and the piston head.

The ring element is for reducing the gap between the ring wall and the projection, in particular, this also results in a simple and inexpensive possibility of further improving the utilization of the available oil amount for cooling the piston.

Other optional features of the invention may include that the piston head is formed from a blank made from forgeable, heat resistant steel. Alternatively, the blank could be made from forgeable aluminum alloy.

To machine this piston blank, a lathe could be used to produce the piston head. Another optional step could include affixing a ring element on an inside face of the ring wall in a pin-boss-side region, wherein the pin bolt side edge of the ring element reaches into the cooling channel.

This ring element can have a cross-section that is shaped as a nose directed radially inward. In addition, this ring element can be formed from an elastically resilient material. Furthermore, this ring element can be formed from plastic, and wherein the step of affixing the ring element comprises gluing the ring element on a radially inside face of the ring wall.

Furthermore, the step of forming the ring element can include forming a ring element having a circumferential molded on part; and then the step of affixing the molded on part includes forming this part into a circumferential groove formed in a radially inside face of the ring wall.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
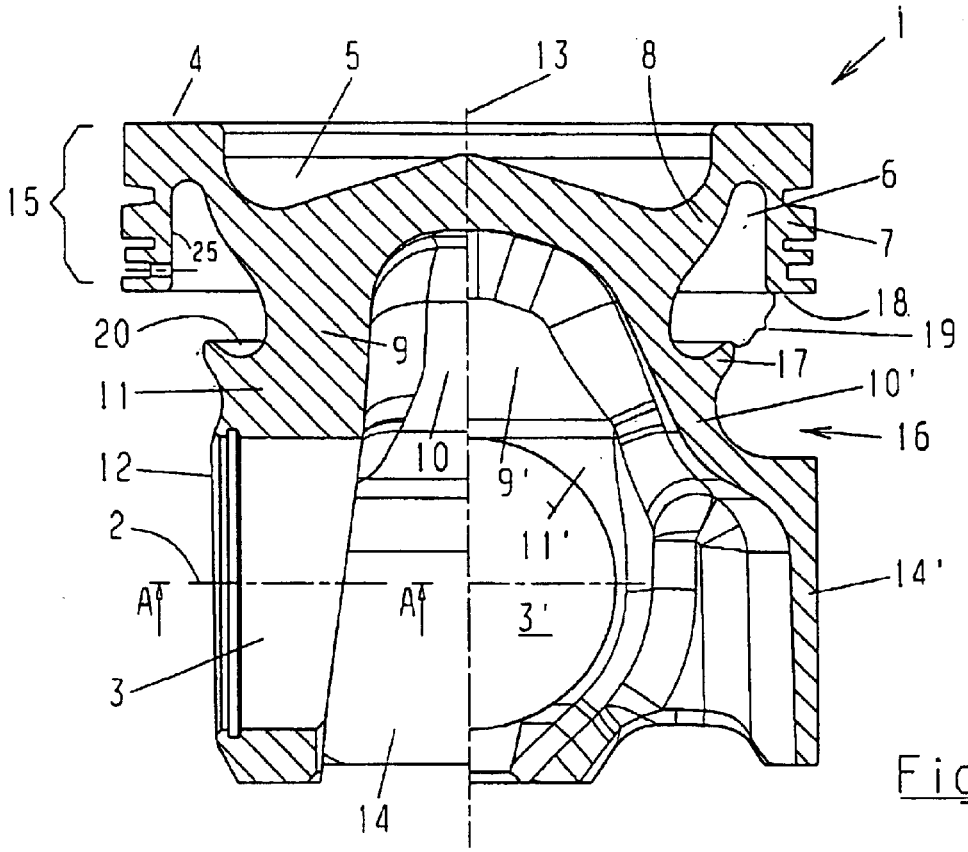
FIG. 1 is a side view of a piston for an internal combustion engine, having a cooling channel, which is partly closed off, by a channel-shaped projection, represented in a cross-sectional diagram comprising two halves, which shows two longitudinal sections of the piston, offset by 90°.

Turning now in detail to the drawings, FIG. 1 shows a piston 1 for an internal combustion engine, structured in one piece, in a cross-sectional diagram that comprises two halves. The left half shows a cross-section of piston 1 along a longitudinal axis 2 of a pin bore 3, and the right half shows a cross-section of piston 1 offset from the first half by 90°. Piston 1 can be made of steel and has a combustion bowl 5 in region of piston head 4. A ring-shaped, circumferential cooling channel 6 is arranged in the radially outer region of piston head 4, wherein a radially outer delimitation 25 of this channel is formed by a ring wall 7 molded onto piston head 4, and the radially inner delimitation of this channel is formed partly by a ring rib 8, partly by a pin boss support 9, 9', and partly by a skirt connection 10, 10'. With this design, ring wall 7 serves as a piston ring carrier.

Pin boss supports 9, 9', help form a pin boss 11, 11', with a pin bore 3, 3', which is molded onto piston head 4, in each instance. Faces 12 of pin bosses 11, 11' are arranged set back relative to ring wall 7, in the direction of longitudinal piston axis 13. Pin bosses 11, 11' are connected with one another by way of skirt elements 14, 14', which are each molded onto piston head 4 by way of a skirt connection 10, 10'. Between skirt elements 14, 14' and piston-head-side region 15 of piston 1, are recesses 16.

Cooling channel 6 is partly closed off, in the direction of pin bosses 11, 11', by a circumferential projection 17 structured as an oil groove, which is molded on partly to pin boss support 9, 9' and partly to skirt connection 10, 10'. Projection 17, together with pin-boss-side face 18 of ring wall 7, forms a gap 19.

Figure 2:
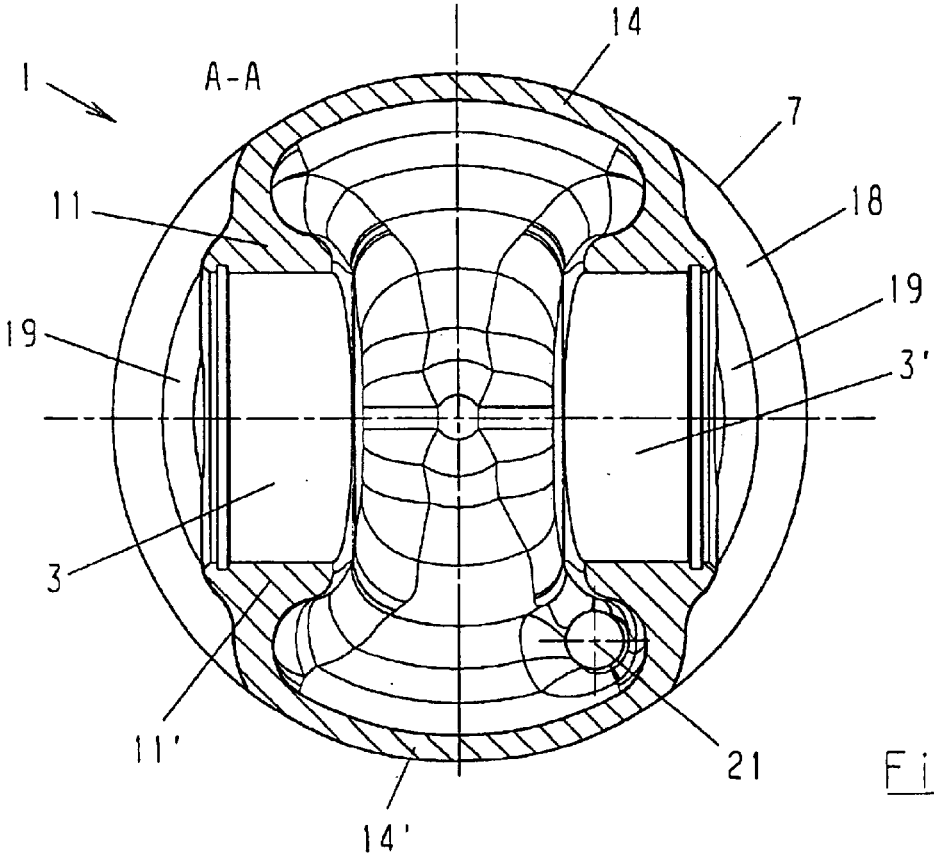
FIG. 2 is a cross-section of the piston along the line A—A in FIG. 1.

The cross-section shown in FIG. 2, along the line A—A in FIG. 1, shows skirt elements 14, 14', pin bosses 11, 11', pin bores 3, 3', face 18 of ring wall 7, gap 19, and an opening 21 that opens into cooling channel 6, for supplying cooling oil. Cooling channel 6 is not shown in FIG. 1 because of the position of the cross-sections. Oil is injected into cooling channel 6 through this opening 21, from the side that faces away from piston head 4, wherein oil hits the bottom of piston head 4, cools piston head 4, and subsequently partly exits from cooling channel 6, by way of gap 19, and is partly collected by groove-shaped projection 17. Oil captured by undercut 20 (FIG. 1) of projection 17 can be used again, multiple times, to cool ring wall 7 and piston head 4, during the next back and forth movements of piston 1.

Figure 3:
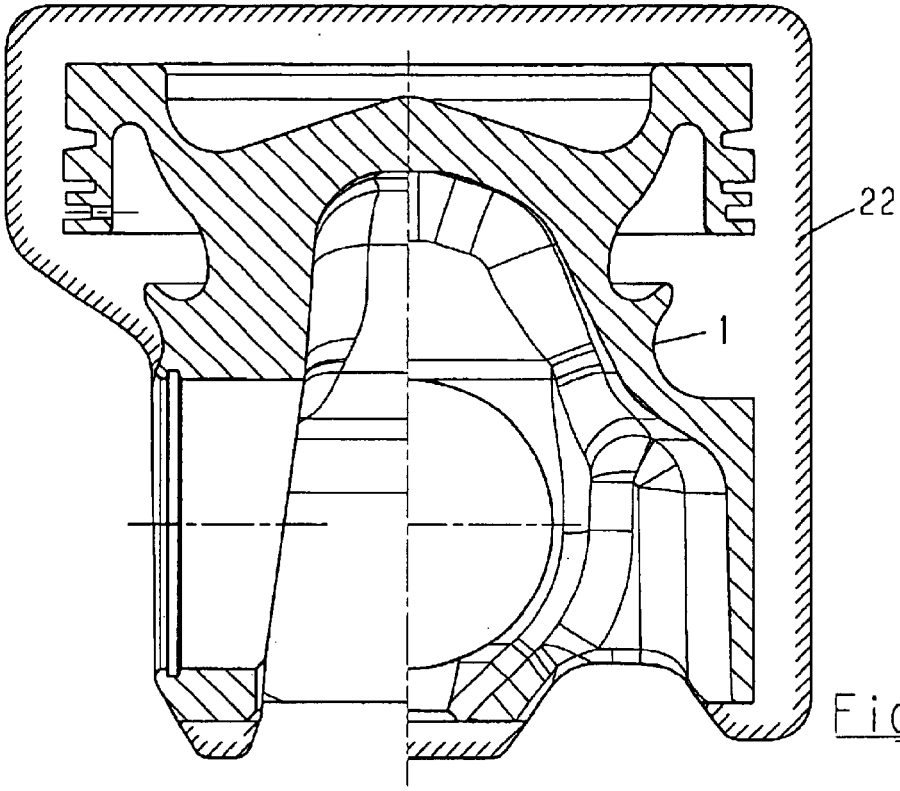
FIG. 3 is a forged piston blank.

FIG. 3 shows an outline of a piston blank 22 made of steel, which was produced using the forging process, and the drawing shows finished piston 1, to be produced by lathing, from this blank.

Figure 4:
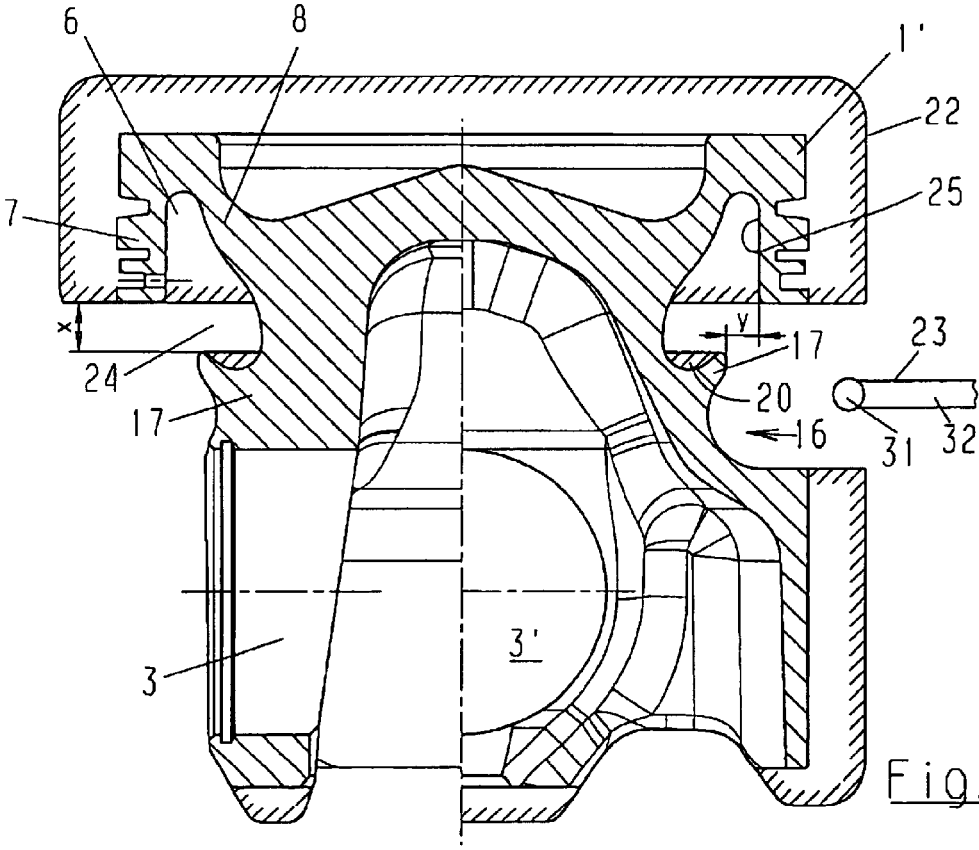
FIG. 4 is a cross sectional view of the result of the first work steps for the production of the piston.

In a first set of method steps, according to FIG. 4, recess 16 and a ring-shaped gap 24 are lathed out of piston blank 22, using a lathe 23, which comprises a round cutting plate 31 with a tool holder 32, whereby the projection 17 is also produced, without an undercut 20. During these first method steps, care must be taken to ensure that the axial width x of gap 24 between projection 17 and the bottom of ring wall 7 is large enough so that lathing tools 26 to 30, shown in FIGS. 5 and 6, can be used for the production of cooling channel 6 and undercut 20. Furthermore, attention must be paid to ensure that the radial distance y between the radially outer edge of projection 17 and the radially outer delimitation 25 of the intended cooling channel 6 is as small as possible, but still large enough so that angled tools 28 and 30, particularly shown in FIG. 6, can be inserted between ring wall 7 and projection 17 from below, to produce cooling channel 6.

Figure 5:
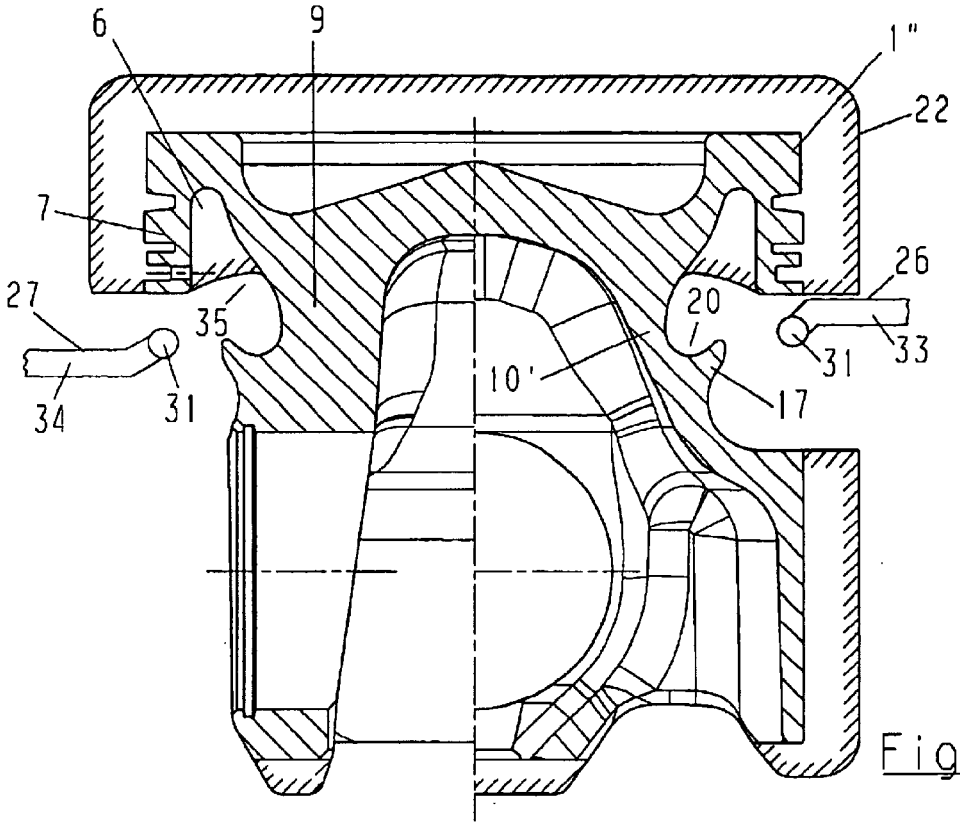
FIG. 5 is a cross sectional view of another step in the production of the piston.

FIG. 5 shows two method steps for the production of piston 1". In the right half of the cross-sectional diagram, a lathing tool 26 is shown, in which cutting plate 31 is held by a tool holder 33 that is angled down by approximately 45° in a front region. The undercut 20 is lathed into projection 17 with this tool.

A first step for the production of cooling channel 6, shown in the left half of the cross-sectional diagram, takes place using lathing tool 27, in which cutting plate 31 is attached to a tool holder 34 that is angled up by approximately 30°. Using this tool, a recess 35 can be lathed into the region between ring wall 7 and pin boss support 9, 9', for example, skirt connection 10, 10'.

Figure 6:
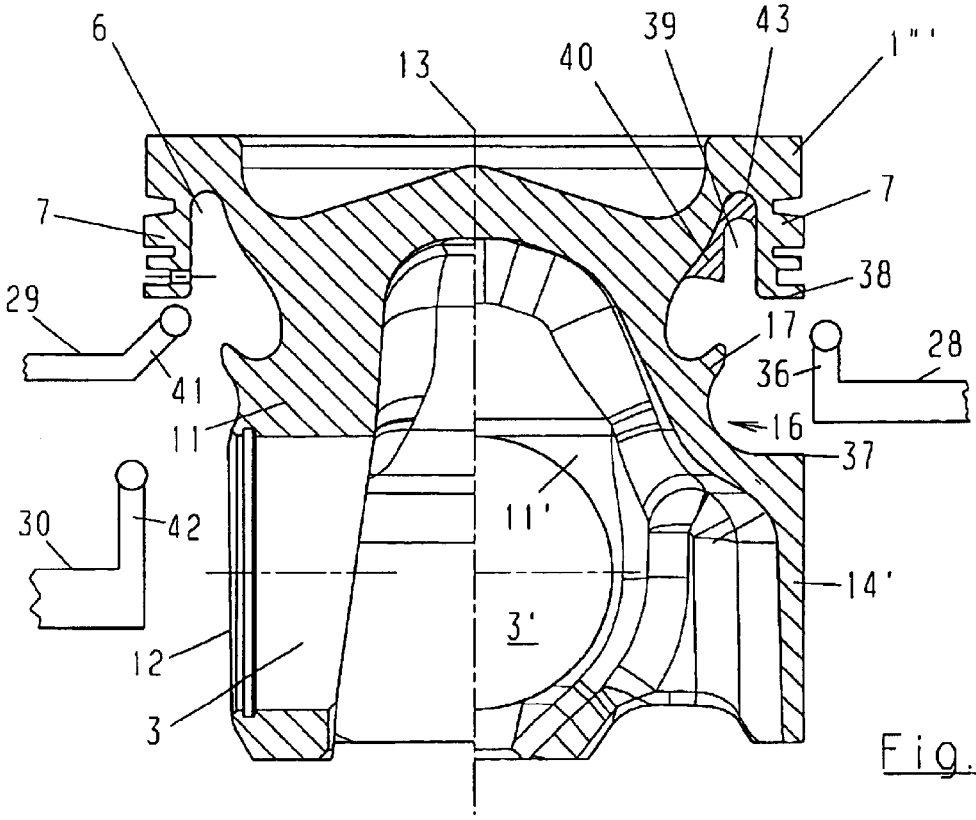
FIG. 6 is another step in the production of the cooling channel and a projection structured as an oil groove.

FIG. 6 shows the final steps for the production of cooling channel 6. With this design, a recess 39 is first produced, using a lathing tool 28, having an arm 36 that is angled upward at a right angle, in the front region, wherein this arm is shorter than the distance between top edge 37 of skirt element 14, 14', and bottom edge 38 of ring wall 7. With this design, the limited length of arm 36 makes it possible for a lathing tool 28 to be set onto any desired location of piston side, and also in a region between ring wall 7 and skirt element 14, 14', to start with the first step for the production of cooling channel 6.

With this design, a residual region 40 is left, which can be removed using the lathing tool 29, which has an arm 41 angled upward by approximately 45° in its front region. Completion of cooling channel 6 takes place using the lathing tool 30. In this case, there is arm 42 of which is angled off at a right angle, and is long enough to lathe out residual region 43. Depending on the desired height of cooling channel 6, arm 42 can be longer than the distance between top edge 37 of skirt element 14, 14' and bottom edge 38 of ring wall 7. In this case, it is necessary to introduce lathing tool 30 into recess 39 in the region of face 12 of pin bosses 11, 11', which are arranged set back relative to ring wall 7, to start the lathing process. A sufficiently large recess 16 then makes it possible so that the lathing process proceeds without hindrance from skirt elements 14, 14', with arm 42 moved into recess 39 and piston 1'" having been put into rotation.

Subsequent to this, the outside contours of piston 1'" are lathed in a known manner, using lathing tools suitable for this purpose, not shown in FIG. 6, and then pin bores 3, 3' are made. The piston shown in FIG. 1 and 2 is the result.

Figure 7:
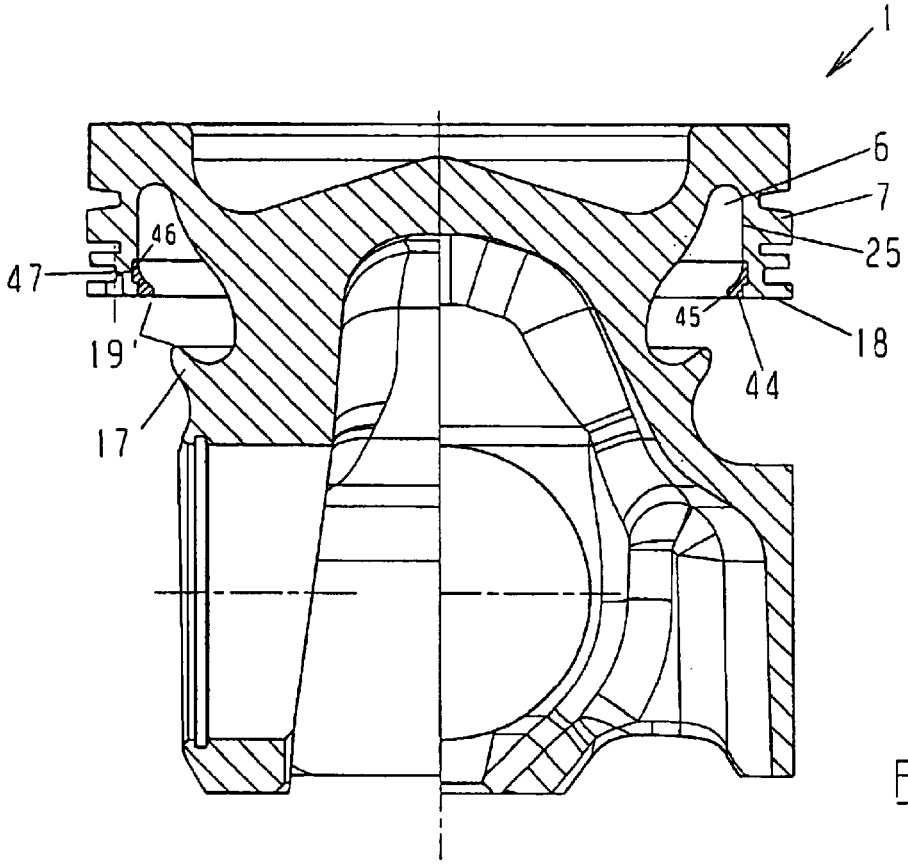
FIG. 7 is an embodiment of the piston according to the invention, with a ring element affixed to the face of the ring wall.

To better utilize the available oil amount for cooling of piston 1, according to FIG. 7 the amount of the cooling oil that exits from gap 19' during the back and forth movements of piston 1 is reduced, wherein gap 19' is reduced in size in comparison with gap 19. For this purpose, a ring element 44, structured in one piece and having a radial gap, is affixed to the inside of pin-hub-side face 18 of ring wall 7, which element can comprise metal or plastic, the inside of which has a shape of a nose 45 directed inward, in cross-section. To attach ring element 44, there is a circumferential molded-on part 46, which fits into a correspondingly shaped, circumferential groove 47, which is made in inside of ring wall 7 in the region of face 18.

Assembly of ring element 44 takes place wherein it is bent apart and laid around piston 1 between ring wall 7 and projection 17. The gap of ring element 44 subsequently allows pressing ring element 44 together and thereby reducing its radius to such an extent that it can be introduced from below into cooling channel 6, until the molded-on part 46 of the ring element 44 catches into groove 47. If the ring element 44 is made of metal, its inherent stress is sufficient to permanently fix ring element 44 in place in cooling channel 6. If ring element 44 is made of plastic, a suitable adhesive is required to fix it in place.

Accordingly, while at least one embodiment of the present invention have been shown and described, it is to be understood that many changes and modifications may be made thereunto without departing from the spirit and scope of the invention as defined in the appended claims.

REFERENCE SYMBOL LIST

1, 1', 1" piston
2 longitudinal axis
3, 3' pin bore
4 piston head
5 combustion bowl
6 cooling channel

7 ring wall
8 ring rib
9, 9' pin boss support
10, 10' skirt connection
11, 11' pin boss
12 face of the pin boss 11, 11'
13 longitudinal piston axis
14, 14' skirt element
15 piston-head-side region of the piston 1
16 recess
17 projection
18 face of the ring wall 7
19, 19' gap
20 undercut of the projection 17
21 opening
22 piston blank
23 lathing tool
24 gap
25 radially outer delimitation of the cooling channel 6, inside of the ring wall 7
26–30 lathing tool
31 round cutting plate
32–34 tool holder(s)
35 recess
36 arm
37 top edge of the skirt element 14
38 bottom edge of the ring element 7
39 recess
40 residual region
41 42 arm
43 residual region
44 ring element
45 nose
46 molded-on part
47 groove

What is claimed is:

1. A method for the production of a one piece piston for a combustion engine, wherein the method comprises the following steps:

forging a piston head from a piston blank wherein said piston head extends along a longitudinal axis and is formed in a substantially cylindrical manner having a radial outer edge;

cutting said piston head to form a recess on a side of said piston head forming a ring wall and a protrusion which results in a ring shaped gap between said protrusion and said ring wall, wherein said protrusion has an outer radial edge that is radially inside of a radial inside edge of said ring wall by a distance (y);

machining a cooling channel using a machine tool having a width that is smaller than said distance (y) wherein said cooling channel is disposed in an outer region of said piston head with a radially outer delimination formed by said radial inside edge of said ring wall molded into said piston head, and a radially inner delimination which is formed by a ring wall molded onto said piston head;

machining said projection by forming a groove shaped undercut, which faces towards said piston head, structured as an oil groove, which is integral with and extends on to said at least one pin boss support and partly onto at least one skirt connection wherein said cooling channel is partly closed off towards a side of said pin bosses wherein said radially inner delimination of said cooling channel is formed partly by said at least one pin boss support and partly by said at least one skirt connection;

machining at least one pin bore in said piston head wherein said at least one pin bore forms at least one pin boss having at least two pin boss supports and at least one face formed integral with said piston head, wherein said at least two pin boss supports and said at least one face are arranged set back relative to said radial outer edge of said piston head; and machining an outside contour of said piston wherein this step includes forming at least two skirt elements coupled to said at least one pin boss in said piston head, via a skirt connection having at least one recess between said skirt elements and said piston head.

2. The method as in claim 1, wherein said step of forging said piston head comprises forging a blank made from forgeable, heat resistant steel.

3. The method as in claim 1, wherein said step of forging said piston head comprises forging a blank made from forgeable aluminum alloy.

4. The method as in claim 1, wherein said step of forging a blank to produce said piston head comprises using a lathe to produce said piston head.

5. The method as in claim 1, further comprising the step of affixing a ring element on an inside face of said ring wall in a pin-boss-side region, wherein said ring element has a pin boss side edge which extends into said cooling channel.

6. The method as in claim 5, wherein said ring element has a cross-section that is shaped as a nose directed radially inward.

7. The method as in claim 5, wherein said ring element is formed from an elastically resilient material.

8. The method as in claim 5, further comprising the step of forming said ring element from plastic, and wherein said step of affixing said ring element comprises gluing said ring element on said radially inside face of said ring wall.

9. The method as in claim 5, wherein said step of forming said ring element includes forming a ring element having a circumferential molded on part; and said step of affixing said ring element includes affixing said molded on part into a circumferential groove formed in a radially inside face of said ring wall.

10. A method for the production of a one piece piston for a combustion engine wherein the method comprises the following steps:

forging a piston head from a piston blank;

cutting said piston head to form a recess on a side of said piston head forming a ring wall and a projection which results in a ring shaped gap between protrusion and said ring wall, wherein said protrusion has an outer radial edge that is radially inside of a radial inside edge or ring wall by a distance (y);

machining a cooling channel using a machine tool having a width that is smaller than said distance (y);

machining said projection by forming a groove shaped undercut, which faces towards said piston head, structured as an oil groove, which is molded partly on to said at least one pin boss support and partly onto said at least one skirt connection;

machining at least one pin bore in said piston head; and machining an outside contour of said piston.

* * * * *